US006672217B1

(12) United States Patent
Tracy et al.

(10) Patent No.: US 6,672,217 B1
(45) Date of Patent: Jan. 6, 2004

(54) PYROTECHNIC INCENDIARY GRENADE HOLDING DEVICE

(75) Inventors: Gene V. Tracy, Jarrettsville, MD (US); Eugene Song, Ellicott City, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/179,676

(22) Filed: Jun. 25, 2002

(51) Int. Cl.[7] ..... F42B 12/44
(52) U.S. Cl. ..... 102/358; 102/364
(58) Field of Search ..... 102/343, 349, 102/358, 364; 86/50; 248/346.01

(56) References Cited

U.S. PATENT DOCUMENTS 462,596 A * 11/1891 Shephard ..... 102/343
2,049,407 A * 7/1936 Clark ..... 248/520
2,090,911 A * 8/1937 Frizzel et al. ..... 102/343
2,129,200 A * 9/1938 Damon ..... 431/146
2,306,442 A * 12/1942 Holmes ..... 431/146
H865 H * 1/1991 Sery et al. ..... 102/306
6,220,166 B1 * 4/2001 Cherry ..... 102/305

* cited by examiner

*Primary Examiner*—Charles T. Jordan
*Assistant Examiner*—Susan C. Alimenti
(74) *Attorney, Agent, or Firm*—Ulysses John Biffoni

(57) ABSTRACT

A holding device for a pyrotechnic, incendiary device. More particularly, a holding device for a thermite or thermate based destructive device or enhanced incendiary grenade. The device assembly allows for firm attachment of pyrotechnic, incendiary devices, particularly enhanced incendiary grenades, to targets having various surface shapes and orientations, or formed of various materials. The holding device is inexpensive and easily reproducible.

17 Claims, 2 Drawing Sheets

PYROTECHNIC INCENDIARY GRENADE HOLDING DEVICE

GOVERNMENT INTEREST

The invention described herein may be manufactured, used and licensed by or for the U.S. Government.

BACKGROUND OF THE INVENTION

1. Field of the Invention

The invention relates to a holding device for a pyrotechnic device. More particularly, the invention pertains to a holding device for a thermite based destructive device or enhanced incendiary grenade as described in U.S. Pat. No. 5,698,812.

2. Description of the Related Art

An enhanced incendiary grenade (EIG) is a device that directs the reaction products of a thermate composition through a nozzle to produce a jet of molten iron and gases. One grenade containing approximately 350 g of thermate (TH3) charge is capable of burning through 1" thick steel in approximately 10 seconds. To insure maximum penetration of a target, the EIG was designed such that it could withstand the intensity of the reaction and provide containment of the reaction products. This was achieved by designing special grenade cans with graphite liners. The EIG was also designed to direct the reaction products out in a manner that produced a penetrating jet of material. This was achieved by designing a nozzle. The design also included vents that helped to keep the EIG in one place for the entire time of reaction by reducing the force generated by the nozzle's jet on the surface of the target. However, this design is only capable of holding the EIG in place on a flat, horizontal target surface, while it is desirable to have an EIG that is capable of being attached to targets having various surface shapes, orientations and materials, and capable of withstanding the intensity of the reaction.

Initial efforts to solve this need using adhesives were unsuccessful because adhesives applied to the bottom of the EIG grenade body generally do not have sufficient contact surface area and lose their adhesive properties when exposed directly to high temperatures generated from functioning an EIG. Another effort to solve the problem was by using magnetic devices to attach the EIG to a target surface. However, such magnetic devices were too cumbersome and would only work with materials that were attracted to a magnet. In addition, previous efforts were also unsuccessful in attaching the EIG to curved or irregular target surfaces, which is desirable. Therefore, there is a need in the art to have a means of attaching an EIG to a wide variety of surfaces that does not add excessive weight or size to the pyrotechnic device, that attaches firmly to a wide variety of target materials with a wide range of surface types and orientations, while being inexpensive and easily reproducible.

The present invention offers a solution to this need in the art. The invention provides an article for supporting a pyrotechnic, incendiary device which comprises a base firmly coupled with the device and surrounding an outer periphery of the device, and a plurality of support members pivotally attached to and extending from the base. The support members are generally loops of metal wire that are preferably spaced equidistant from each other along a circular base. The support members may be positioned anywhere along the base and may be folded up or down to simplify transport of the device. The article also includes adhesive foam pads attached to the support members for attaching the device to a variety of target surfaces.

SUMMARY OF THE INVENTION

The invention provides a pyrotechnic, incendiary device assembly comprising a pyrotechnic, incendiary device; a base firmly coupled with the device, which base surrounds an outer periphery of the device; and a plurality of support members pivotally attached to and extending from the base; said support members being laterally spaced from each other along said base and having top and bottom surfaces.

The invention also provides a support for a pyrotechnic, incendiary device comprising a base firmly coupled with the device, which base surrounds an outer periphery of the device; and a plurality of support members pivotally attached to and extending from the base; said support members being laterally spaced from each other along said base and having top and bottom surfaces.

The invention further provides a support for a pyrotechnic, incendiary grenade comprising:

a base firmly coupled with the grenade, which base surrounds an outer periphery of the grenade; and a plurality of support members pivotally attached to and extending from the base; said support members being laterally spaced from each other along said base and having top and bottom surfaces.

DETAILED DESCRIPTION OF THE PREFERRED EMBODIMENTS

Figure 1:
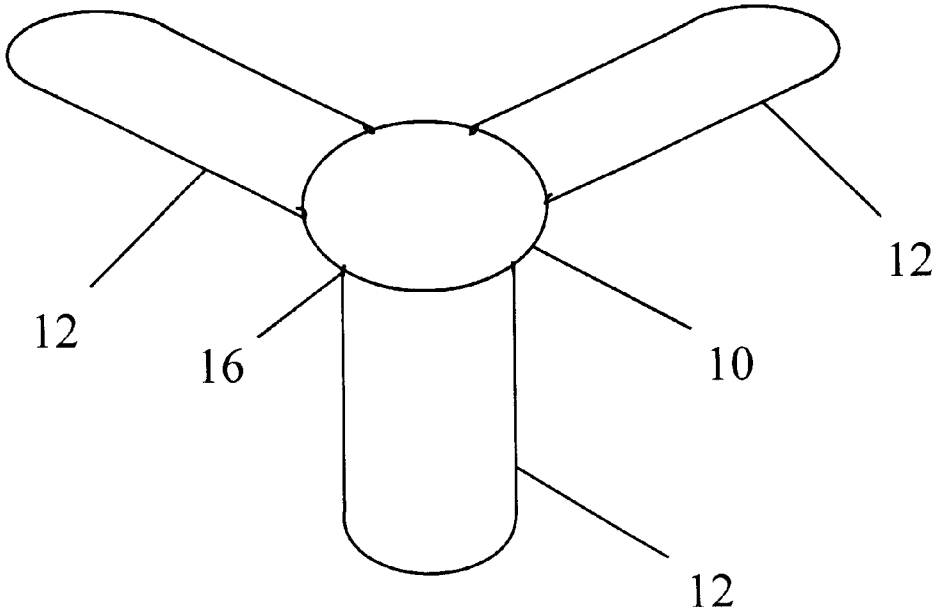
FIG. 1 is a top-view schematic representation of a holding device of the invention with no pyrotechnic, incendiary device attached.
Figure 2:
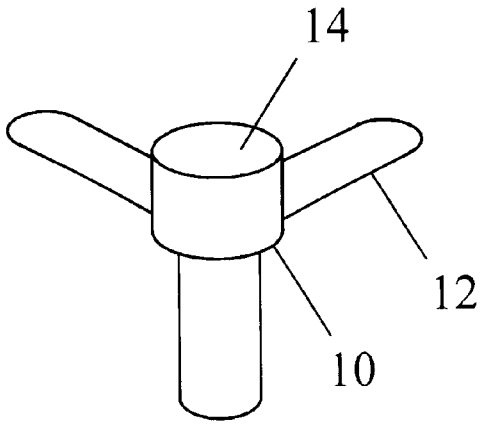
FIG. 2 is a perspective view of a holding device of the invention having a pyrotechnic, incendiary device attached.

The assembly as claimed is suitable for supporting a pyrotechnic, incendiary device. As seen in FIGS. 1 and 2, the assembly comprises a pyrotechnic, incendiary device 14, a base 10 surrounding an outer periphery of the device and being firmly coupled with the explosive device 14, and a plurality of support members 12 pivotally attached to and extending from the base 10. As seen in FIG. 1, the base is preferably, but not necessarily circular, and the support members 12 are laterally spaced from each other along the circular base 10 and have top and bottom surfaces. In the preferred embodiment of the invention the support members 12 are spaced substantially equidistant from each other along the base 10. The base 10 is preferably formed of a material which non-exclusively includes metals selected from the group comprising copper, iron, aluminum and alloys and combinations thereof, or other suitable material, e.g. a plastic, that is able to withstand high temperatures. Of these, heavy gauge copper wire is the most preferred material.

Heavy gauge copper wire is the most preferred because it is very malleable and may be easily formed to fit a wide variety of surface contours. This allows the loops with attached foam pads to wrap around and adhere to objects such as pipes, projectiles, and large caliber gun barrels. The copper loops are adaptable to many other shapes and may be bent to facilitate placing and holding the enhanced incendiary grenade in a confined area or at a particular location. The copper is also preferred because it has a high melting point that can withstand the high temperatures associated with the functioning of an EIG, and is an excellent conductor of heat. This conductive property is important because heat is rapidly conducted away from the area of intense heat before the melting point of the copper is reached. Furthermore, the copper wire serves as an effective heat sink when surrounded by adhesive foam pads, as well as functioning as a holding device. Copper is also preferred because it is generally inexpensive and widely available.

Figure 3:
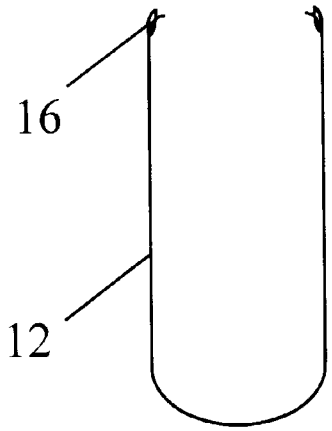
FIG. 3 is a top-view of a single support member.

Each of the base 10 and support members 12 are preferably, but not necessarily, formed of the same material. Support members 12 may comprise, for example, shaped wire loops, strips of metal, or other shaped member that would be well suited to holding a pyrotechnic, incendiary device on a target. For example, shown in FIG. 3 is a schematic representation of an individual support member 12 unattached to the base 10. As seen in the figure, the support members 12 may be formed into U-shaped, wire loops.

Figure 5:
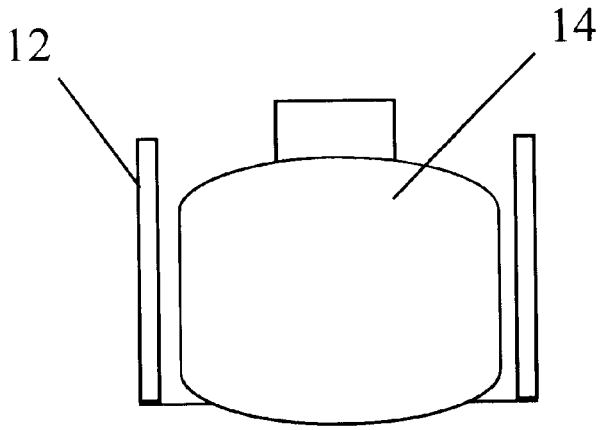
FIG. 5 is a schematic representation of a holding device of the invention having three support members folded upward at a 90° angle to the base.

Each support member 12 is pivotally attached to the base via a pivot 16 at the end of each member 12. These pivots 16 may comprise any suitable structure, such as rounded rings attached to the base 10, or clamp that enables the support members 12 to pivot about the base 10. This allows the support members 12 to be alternately folded within or perpendicular to a plane containing said base. This embodiment can be seen in FIG. 5, where each of three U-shaped support members 12 are pivoted upward, perpendicular to a plane of base 10. When the support members 12 are folded in this manner, storage and transport of the device is simplified. The pivots 16 are preferably formed from the same material as the support members 12 and/or base 10.

In the preferred embodiment of the invention, the support members 12 are preferably about 2 inches to about 12 inches in length, more preferably at least about 4 inches in length, respective to the length at which they extend from the base. In the preferred embodiment of the invention, the support members 12 are U-shaped, and the U-shaped support members are preferably from about 0.5 to about 4 inches wide, more preferably at least about 1 inch wide.

Figure 4:
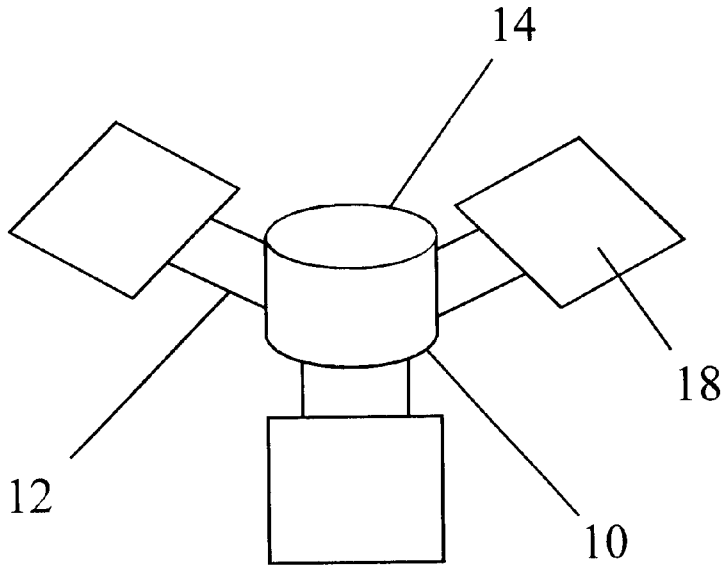
FIG. 4 is a perspective view of a holding device of the invention having adhesive foam pads attached to the support members.

In the practice of the invention, the objective of the holding assembly is to firmly attach a pyrotechnic, incendiary device to targets having various surface shapes and orientations, or from various materials. In order to achieve this objective, it is preferred that each of the support members 12 have a pad 18, preferably an adhesive pad, attached to at least the bottom surface of each member 12, more preferably having pads 18 attached to each a bottom and a top surface of each support member 12. This is seen in FIG. 4. Preferably an outer surface of each of the pads has a pressure sensitive adhesive thereon, allowing the assembly to be attached onto a variety of surfaces. Preferred adhesive pads are adhesive foam tape. Adhesive foam tape is commercially available, such as, but not limited to, tape product no. 4008 manufactured by 3M®. This particular foam tape is a ⅛ inch thick double-coated polyurethane foam backed tape. This foam tape is preferred because the foam backing of the tape tends to insulate the adhesive contact layer in contact with the target material from extreme temperatures generated while functioning of an EIG. The foam may also shield the adhesive layer by functioning as an ablative material as it decomposes. Accordingly, the metal of the support member 12 is preferably held between two layers of the foam backed tape, which holds the member securely in place even as the metal heats up.

The claimed assembly is intended to be suitable for holding a variety of pyrotechnic devices, including grenades. However, the assembly is particularly intended for application with enhanced incendiary grenades (EIGs) as described in U.S. Pat. No. 5,698,812, which is incorporated herein by reference.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A pyrotechnic incendiary device assembly, comprising:

(a) a pyrotechnic incendiary device;

(b) a base firmly coupled with said device, said base surrounding an outer periphery of said device;

(c) a plurality of support members pivotally attached to and extending from said base, said support members being laterally spaced apart from each other along said base and having top and bottom surfaces, and wherein said support members comprise a malleable metal wire adaptable so that said support members may be formed to fit a wide variety of surface contours; and (d) a pressure sensitive adhesive pad attached to at least said bottom surface of each support member so that said adhesive pad causes said adaptable support members to adhere to a surface contour thereby affixing said incendiary device to said surface.

2. The assembly of claim 1, further comprising a pressure sensitive adhesive pad attached to the top surface of said support members.

3. The assembly of claim 1, wherein said base and support members comprise a metal selected from the group consisting of copper, iron, aluminum, and alloys and combinations thereof.

4. The assembly of claim 2, wherein said support members comprise copper.

5. The assembly of claim 1, wherein said device comprises an incendiary grenade.

6. The assembly of claim 1, wherein said support members comprise loops.

7. The assembly of claim 1, wherein said support members are laterally spaced apart along said base substantially equidistant from each other.

8. The assembly of claim 1, wherein said plurality of support members comprises three support members laterally spaced apart along said base, each of said support members being substantially equidistant from each other.

9. The assembly of claim 1, wherein said support members are about 2 inches to about 12 inches in length.

10. The assembly of claim 1, wherein said support members are at least about 4 inches in length.

11. The assembly of claim 1, wherein said support members are from about 0.5 to about 4 inches wide.

12. The assembly of claim 1, wherein said support members are at least about 1 inch wide.

13. The assembly of claim 1, wherein each of said support members have a pivot at the end of each support member.

14. The assembly of claim 13, wherein said pivot comprises a rounded ring that is pivotally connected to said base.

15. The assembly of claim 1, wherein said support members are capable of being alternately folded within or perpendicular to a plane containing said base.

16. The assembly of claim 1, wherein said adhesive pads insulate said support members from heat generated by said incendiary device.

17. The assembly of claim 1, wherein said adhesive pads function as an ablative material to shield said support members from heat generated by said incendiary device.

* * * * *